US005527195A

United States Patent [19]

Neisen

[11] Patent Number: 5,527,195

[45] Date of Patent: Jun. 18, 1996

[54] FLOW THROUGH MARINE PROPELLER

[75] Inventor: Gerald F. Neisen, Oshkosh, Wis.

[73] Assignee: Brunswick Corporation, Lake Forest, Ill.

[21] Appl. No.: 428,573

[22] Filed: Apr. 25, 1995

[51] Int. Cl.[6] ..... B63H 21/32

[52] U.S. Cl. ..... 440/89; 416/93 A

[58] Field of Search ..... 440/89; 416/93 A, 416/224 B

[56] References Cited

U.S. PATENT DOCUMENTS

| | | | |
|---|---|---|---|
| 2,213,609 | 9/1940 | Ronning | 440/89 |
| 4,778,419 | 10/1988 | Bolle et al. | 440/89 |
| 4,802,872 | 2/1989 | Stanton | 440/89 |
| 5,078,632 | 1/1992 | Ogawa et al. | 440/89 |
| 5,158,433 | 10/1992 | Cleary | 416/93 A |

*Primary Examiner*—Stephen Avila
*Attorney, Agent, or Firm*—Andrus, Sceales, Starke & Sawall

[57] ABSTRACT

A marine propeller (10) has an integral aft skirt portion (30, 74) with a plurality of slots (34, 36, 38, 40, 42, 44) extending forwardly from the trailing end (32, 72) and dividing the skirt portion into a plurality of circumferentially spaced segments (46, 48, 50, 52, 54, 56) separated from each other at the trailing end by respective slots therebetween and integrally joined to each other at the outer hub (14) forwardly of the slots. Aft trailing blade tips (28*e*) of the propeller blades (24, 26, 28) meet the outer hub at points (60) offset from the slots to prevent engine exhaust in the through hub exhaust passage (22) from seeking the negative pressure backside surfaces (28*b*) of the propeller blades through the slots.

13 Claims, 2 Drawing Sheets

FLOW THROUGH MARINE PROPELLER

BACKGROUND AND SUMMARY

The invention relates to marine propellers, and more particularly to flow through type propellers.

Flow through type marine propellers discharge engine exhaust gases through the propeller and beneath the water level at a location behind the boat. Propellers of this type include an inner hub, which is driven by the propeller shaft, and an outer hub which is spaced radially outwardly of the inner hub and is connected thereto by a series of radial spokes legs. The space between the hubs defines an exhaust passage through which the engine exhaust gas is discharged beneath the water level. A plurality of blades are formed integrally with the outer hub.

To improve engine and boat performance, it is known in the prior art to provide a diffuser ring at the trailing end of the outer hub. In Cleary U.S. Pat. No. 5,158,433, incorporated herein by reference, the outer hub has an integral aft skirt portion flared outwardly to a trailing end to provide a diffuser ring. The diffuser ring assists in exhaust gas flow and provides a pressure barrier that helps prevent exhaust gases from feeding back into the propeller blades. This enhances engine and boat performance.

In one aspect of the present invention, structural design improvements are provided enhancing the forming operation of the flare, and reducing cracking and fatigue.

In another aspect of the invention, structural design improvements are provided further enhancing engine and boat performance by preventing exhaust in the exhaust passage from seeking the negative pressure backside surfaces of the propeller blades.

DETAILED DESCRIPTION

Figure 1:
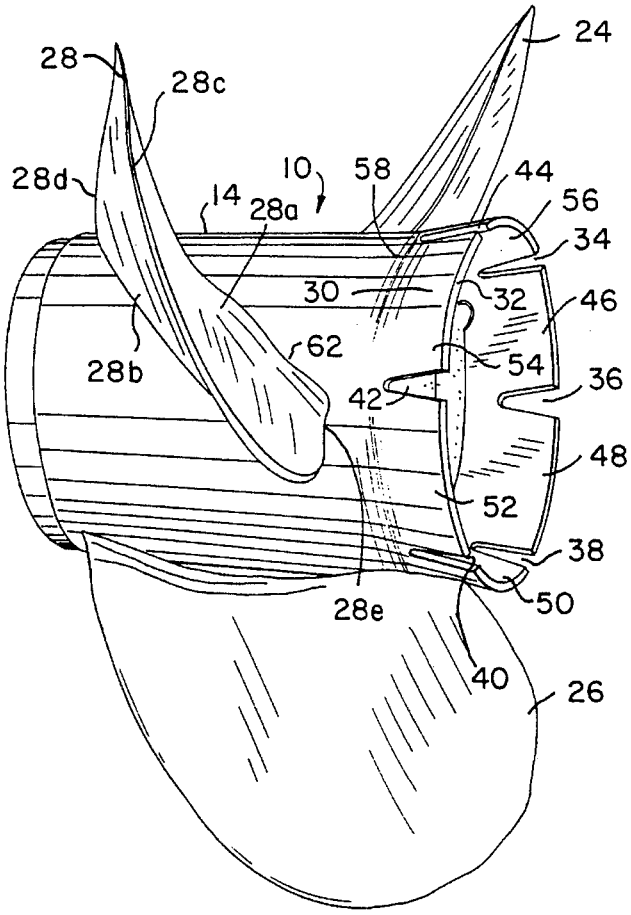
FIG. 1 is an isometric view of a marine propeller in accordance with the invention.
Figure 3:
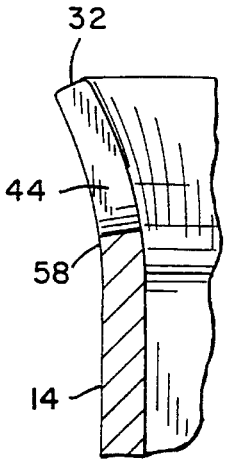
FIG. 3 is a sectional view taken along line 3—3 of FIG. 2.
Figure 2:
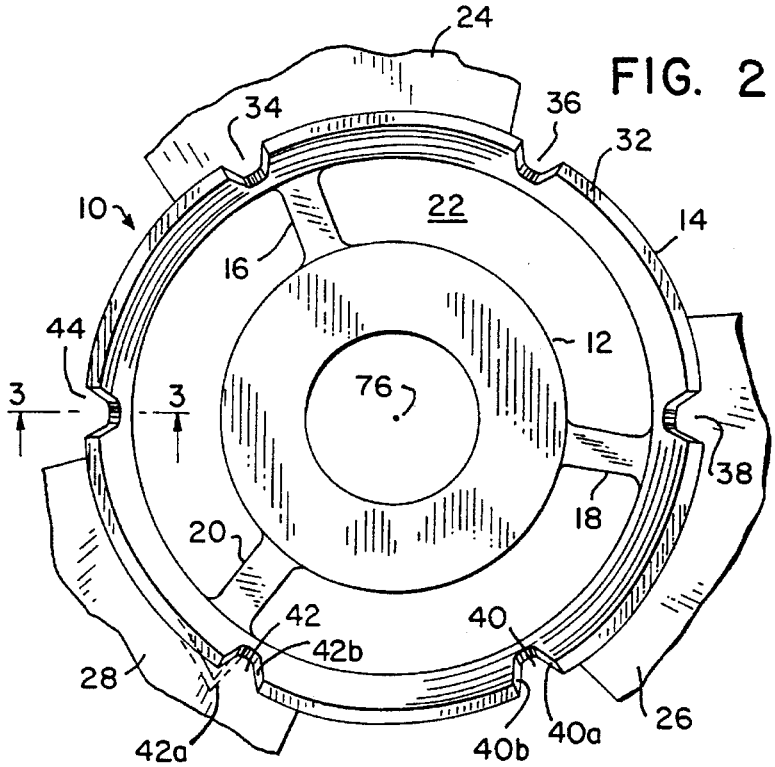
FIG. 2 is an end view from the rear of the propeller of FIG. 1.

FIG. 1 shows a marine propeller 10 having an inner hub 12, FIG. 2, and an outer hub 14 spaced radially outwardly of inner hub 12 by a plurality of radial spokes or legs 16, 18, 20, to provide an exhaust passage 22 between the inner and outer hubs. Propeller blades 24, 26, 28 extend outwardly from outer hub 14. Outer hub 14 has an integral aft skirt portion 30 flared outwardly to a trailing end 32, FIG. 4. A plurality of slots 34, 36, 38, 40, 42, 44 extend forwardly from trailing end 32 along integral aft outwardly flared skirt portion 30 and divide skirt portion 30 into a plurality of circumferentially spaced segments 46, 48, 50, 52, 54, 56 separated from each other at trailing end 32 by respective slots therebetween and integrally joined to each other at outer hub 14 forwardly of the slots. The slots are formed in the outer hub during casting of the propeller, and skirt portion 30 is flared in a flaring operation as described in incorporated U.S. Pat. No. 5,158,433.

Slots 34, 36, 38, 40, 42, 44 have a length extending from trailing end 32 forwardly to an annular transition surface 58. Integral aft outwardly flared skirt portion 30 begins to flare outwardly at annular transition surface 58. The slots are V-shaped with tapered sides, such as 40*a* and 40*b*, FIGS. 2 and 4, diverging aft. The slots facilitate the noted flaring operation, and minimize cracking and fatigue in skirt portion 30 including at annular transition surface 58.

Figure 4:
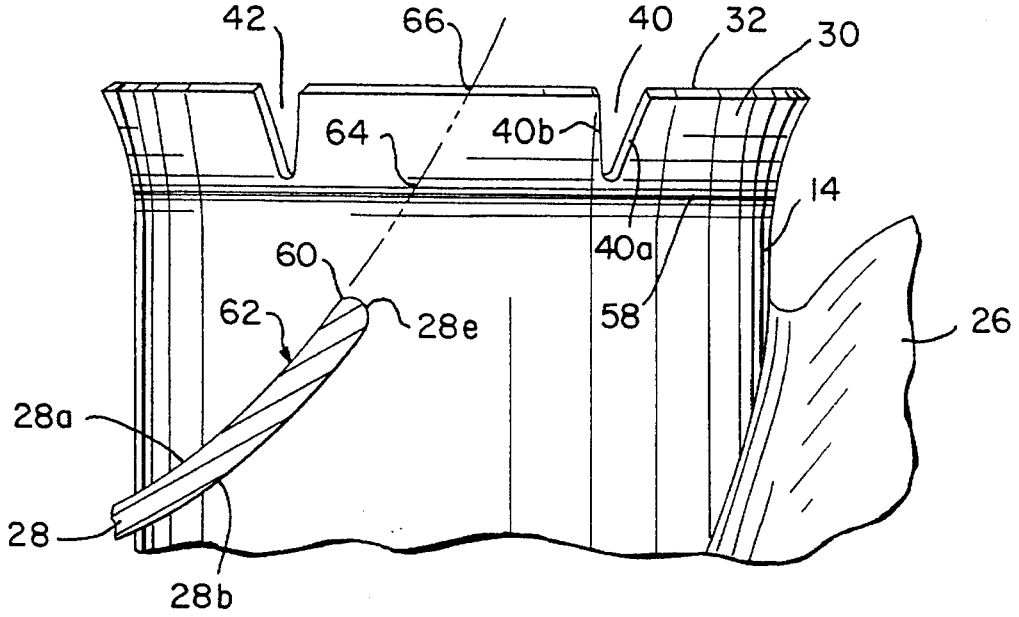
FIG. 4 is a side view, partially in section, of a portion of the propeller of FIG. 1.

The propeller blades have a positive pressure frontside surface such as 28*a*, FIGS. 1 and 4, and a negative pressure backside surface such as 28*b*, for a right hand rotation, i.e. clockwise, propeller as shown in FIG. 1. Frontside surface 28*a* meets backside surface 28*b* at an outer blade tip 28*c* extending around the blade from a forward leading blade tip 28*d* to an aft trailing blade tip 28*e*. Aft trailing blade tip 28*e* merges with outer hub 14 at a point 60, FIG. 4, offset from the slots to prevent exhaust in exhaust passage 22 from seeking the negative pressure backside surface 28*b* through a slot. Blade 28 merges with outer hub 14 along a line of curvature 62 extending from leading blade tip 28*d* to trailing blade tip 28*e* along outer hub 14. An aft extension 64, shown in dashed line in FIG. 4, of line of curvature 62 continuing the same curvature along integral aft outwardly flared skirt portion 30 meets trailing end 32 of outer hub 14 at a point 66 spaced generally centrally between respective slots 40 and 42.

Figure 5:
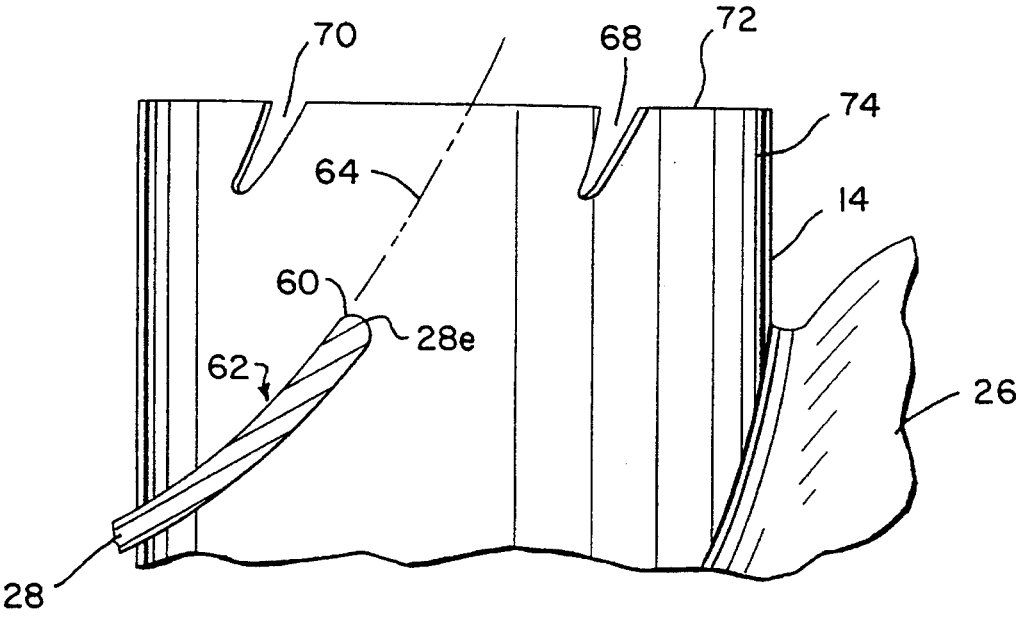
FIG. 5 is a view like FIG. 4 and shows an alternate embodiment.

In the embodiment of FIG. 4, the slots extend axially forwardly from trailing end 32 along integral aft skirt portion 30. In an alternate embodiment as shown in FIG. 5, the slots such as 68 and 70 curve in the direction of rotation of the propeller as the slots extend forwardly from trailing end 72. Slots 68 and 70 extend forwardly from trailing end 72 along respective lines of curvature parallel to line of curvature 62 including aft extension 64. This aspect of the invention is applicable to a propeller having an outwardly flared skirt portion 30, FIG. 4, and to a propeller having a non-flared or straight skirt portion 74, FIG. 5. In each embodiment, the integral aft skirt portion 30 or 74 has a trailing end 32 or 72 aft of the point 60 where the trailing blade tip 28*e* merges with outer hub 14. In preferred form, the propeller has three blades and six slots, each slot being offset from a point of merger of the respective trailing blade tip with the outer hub, though other numbers and combinations of blades and slots may be used.

In a further alternate embodiment, one of the slot sides, for example as shown in dashed line at 42*a* in FIG. 2, is spaced from the axis 76 of rotation of the propeller by a greater radial distance than the other slot side 42*b*, which drafts any exhaust gas flow therethrough at a point offset from the negative pressure backside surface of the propeller blade. Slot side 42*a* leads slot side 42*b* during rotation of the propeller, i.e. the propeller in FIG. 2 rotates clockwise.

It is recognized that various equivalents, alternatives and modifications are possible within the scope of the appended claims.

I claim:

1. A marine propeller comprising an inner hub, an outer hub spaced radially outwardly of said inner hub to provide an exhaust passage therebetween, a plurality of propeller blades extending outwardly from said outer hub, said outer hub including an integral aft skirt portion flared outwardly to a trailing end and having a plurality of slots extending forwardly from said trailing end along said integral aft outwardly flared skirt portion and dividing said integral aft outwardly flared skirt portion into a plurality of circumferentially spaced segments separated from each other at said trailing end by respective slots therebetween and integrally joined to each other at said outer hub forwardly of said slots, wherein said slots are generally V-shaped with tapered sides diverging aft.

2. A marine propeller comprising an inner hub, an outer hub spaced radially outwardly of said inner hub to provide an exhaust passage therebetween, a plurality of propeller blades extending outwardly from said outer hub, said outer hub including an integral aft skirt portion flared outwardly to a trailing end and having a plurality of slots extending forwardly from said trailing end along said integral aft outwardly flared skirt portion and dividing said integral aft outwardly flared skirt portion into a plurality of circumferentially spaced segments separated from each other at said trailing end by respective slots therebetween and integrally joined to each other at said outer hub forwardly of said slots, wherein said blades have a positive pressure frontside surface and a negative pressure backside surface, wherein said frontside surface meets said backside surface at an aft trailing blade tip, and wherein said aft trailing blade tip merges with said outer hub at a point offset from said slots to prevent exhaust in said exhaust passage from seeking said negative pressure backside surface through said slot.

3. The invention according to claim 2 wherein each said blade merges with said outer hub along a respective line of curvature extending from a leading blade tip to said trailing blade tip, and wherein an aft extension of said line of curvature continuing the same curvature along said integral aft outwardly flared skirt portion meets said trailing end of said outer hub at a point spaced generally centrally between respective slots.

4. A marine propeller comprising an inner hub, an outer hub spaced radially outwardly of said inner hub to provide an exhaust passage therebetween, a plurality of propeller blades extending outwardly from said outer hub, each blade having a positive pressure frontside surface and a negative pressure backside surface, said frontside surface meeting said backside surface at an outer blade tip extending around said blade from a forward leading blade tip to an aft trailing blade tip, each blade merging with said outer hub along a line of curvature extending from a leading blade tip to a trailing blade tip, said outer hub including an integral aft skirt portion having a trailing end aft of the point where said trailing blade tip merges with said outer hub, said integral aft skirt portion having a plurality of slots extending forwardly from said trailing end along said integral aft skirt portion and dividing said integral aft skirt portion into a plurality of circumferentially spaced segments separated from each other at said trailing end by respective slots therebetween and integrally joined to each other at said outer hub forwardly of said slots.

5. The invention according to claim 4 wherein said trailing blade tip merges with said outer hub at a point offset from a slot in said integral aft skirt portion to prevent exhaust in said exhaust passage from seeking said negative pressure backside surface through said slot.

6. The invention according to claim 4 wherein an aft extension of said line of curvature continuing the same curvature along said integral aft skirt portion meets said trailing end of said outer hub at a point spaced between respective slots.

7. The invention according to claim 4 wherein said slots are generally V-shaped with tapered sides diverging aft.

8. The invention according to claim 4 wherein said slots extend axially forwardly from said trailing end along said integral aft skirt portion.

9. The invention according to claim 4 wherein said slots curve in the direction of rotation of the propeller as said slots extend forwardly from said trailing end.

10. The invention according to claim 4 wherein said slots extend forwardly from said trailing end along a line of curvature parallel to said line of curvature of said blades.

11. The invention according to claim 4 wherein said propeller has three said blades and six said slots, each slot being offset from a point of merger of said trailing blade tip with said outer hub.

12. The invention according to claim 4 wherein each slot is defined by a pair of opposing sides, and wherein one of said slot sides is spaced from the axis of rotation of the propeller by a greater radial distance than the other slot side.

13. The invention according to claim 12 wherein said one slot side leads said other slot side during rotation of said propeller.

* * * * *